US008376508B2

(12) United States Patent
Ito

(10) Patent No.: US 8,376,508 B2
(45) Date of Patent: Feb. 19, 2013

(54) FLUID EJECTING APPARATUS

(75) Inventor: Koji Ito, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 116 days.

(21) Appl. No.: 12/946,984

(22) Filed: Nov. 16, 2010

(65) Prior Publication Data

US 2011/0115848 A1 May 19, 2011

(30) Foreign Application Priority Data

Nov. 17, 2009 (JP) ..... 2009-261808

(51) Int. Cl.
*B41J 2/165* (2006.01)

(52) U.S. Cl. ..... 347/31

(58) Field of Classification Search ..... None
See application file for complete search history.

(56) References Cited

U.S. PATENT DOCUMENTS

| | | | | |
|---|---|---|---|---|
| 6,679,578 | B2 * | 1/2004 | Arakawa | 347/33 |
| 7,562,961 | B2 | 7/2009 | Inoue | |
| 2005/0062797 | A1 * | 3/2005 | Kachi | 347/33 |
| 2010/0118084 | A1 | 5/2010 | Sheshimo | |

FOREIGN PATENT DOCUMENTS

| | | |
|---|---|---|
| JP | 2005-119284 | 5/2005 |

* cited by examiner

*Primary Examiner* — Matthew Luu
*Assistant Examiner* — Alejandro Valencia
(74) *Attorney, Agent, or Firm* — Workman Nydegger

(57) ABSTRACT

Provided is a fluid ejecting apparatus including: a fluid ejecting head which has nozzle rows formed by a plurality of nozzles and ejects a fluid to a medium; an absorbing member absorbs the fluid that is ejected from the nozzles during a flushing process, and is a linear member which extends along a nozzle row; a first movement mechanism which relatively moves the absorbing member in a direction intersecting the extension direction of the nozzle rows between a retreat position where the absorbing member retreats from the ejection direction of the fluid ejected from the nozzles and a flushing position where the absorbing member overlaps with the ejection direction; and an accommodating portion which is formed on the fluid ejecting head and accommodates the absorbing member at the retreat position.

6 Claims, 14 Drawing Sheets

FLUID EJECTING APPARATUS

CROSS REFERENCES TO RELATED APPLICATIONS

The entire disclosure of Japanese Patent Application No. 2009-261808, filed Nov. 17, 2009, is expressly incorporated by reference herein.

BACKGROUND

1. Technical Field

The present invention relates to a fluid ejecting apparatus, and particularly, to a flushing process of a printing head.

2. Related Art

An ink jet printer (hereinafter, referred to as "a printer") is widely known as a fluid ejecting apparatus which ejects ink droplets onto a printing sheet (medium). In this kind of printer, since ink evaporates from a nozzle of a printing head, ink in the nozzle is thickened or solidified, dust is attached to the nozzle, and bubbles are mixed with the ink in the nozzle, which causes an erroneous printing process. Therefore, generally, in a printer, in addition to an ejection process of ejecting ink to a printing sheet, a flushing process of compulsorily ejecting ink in the nozzle to the outside is performed.

In a scanning-type printer, the flushing process is performed by moving a printing head to an area other than a printing area. However, in a printer including a line head in which a printing head is fixed, the printing head cannot move during a flushing process. Therefore, for example, JP-A-2005-119284 proposes a method of ejecting ink toward absorbing members provided in a surface of a sheet transporting belt.

However, in the method disclosed in JP-A-2005-119284, since the plural absorbing members are arranged at the same interval on the sheet transporting belt in accordance with the size of the printing sheet, problems arise in that ink needs to be ejected in every gap between the printing sheets during the flushing process, and in that the size or transporting speed of the printing sheet is limited. In addition, when the flushing process is performed on a planar absorbing member, ink is scattered in the form of a mist due to a wind pressure caused by an operation of ejecting ink droplets, which may contaminate the printing sheet or the sheet transporting belt.

SUMMARY

An advantage of some aspects of the invention is that it provides a fluid ejecting apparatus capable of simply performing a cleaning (flushing) process within a short time.

In order to solve the above-described problem, some aspects of the invention provide the fluid ejecting apparatus as below.

Provided is a fluid ejecting apparatus including a fluid ejecting head which has nozzle rows formed by a plurality of nozzles and ejects a fluid to a medium, the fluid ejecting apparatus being capable of performing a flushing process in which the fluid is ejected from the nozzles toward an absorbing member absorbing the fluid thereto, wherein the absorbing member is a linear member which extends along the nozzle rows, wherein the fluid ejecting apparatus further includes: a first movement mechanism which relatively moves the absorbing member in a direction intersecting the extension direction of the nozzle rows between a retreat position where the absorbing member retreats from the ejection direction of the fluid ejected from the nozzles and a flushing position where the absorbing member overlaps with the ejection direction; and an accommodating portion which is formed on the fluid ejecting head and accommodates the absorbing member at the retreat position.

The first movement mechanism may change a relative position between the absorbing member and the fluid ejecting head in the ejection direction.

The accommodating portion may be an area defined by a projection portion protruding from the nozzle surface of the fluid ejecting head in the ejection direction and extending in the extension direction of the nozzle row.

The projection height of the projection portion from the nozzle surface may be equal to or larger than the diameter of the cross-section of the absorbing member.

The accommodating portion may be a concave portion which extends in the extension direction of the nozzle row and is formed on the nozzle surface of the fluid ejecting head.

The depth of the concave portion from the nozzle surface may be equal to or larger than the diameter of the absorbing member in the cross-section.

The fluid ejecting apparatus may further include: a second movement mechanism which moves the absorbing member in the extension direction by rotationally driving a rotation body.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
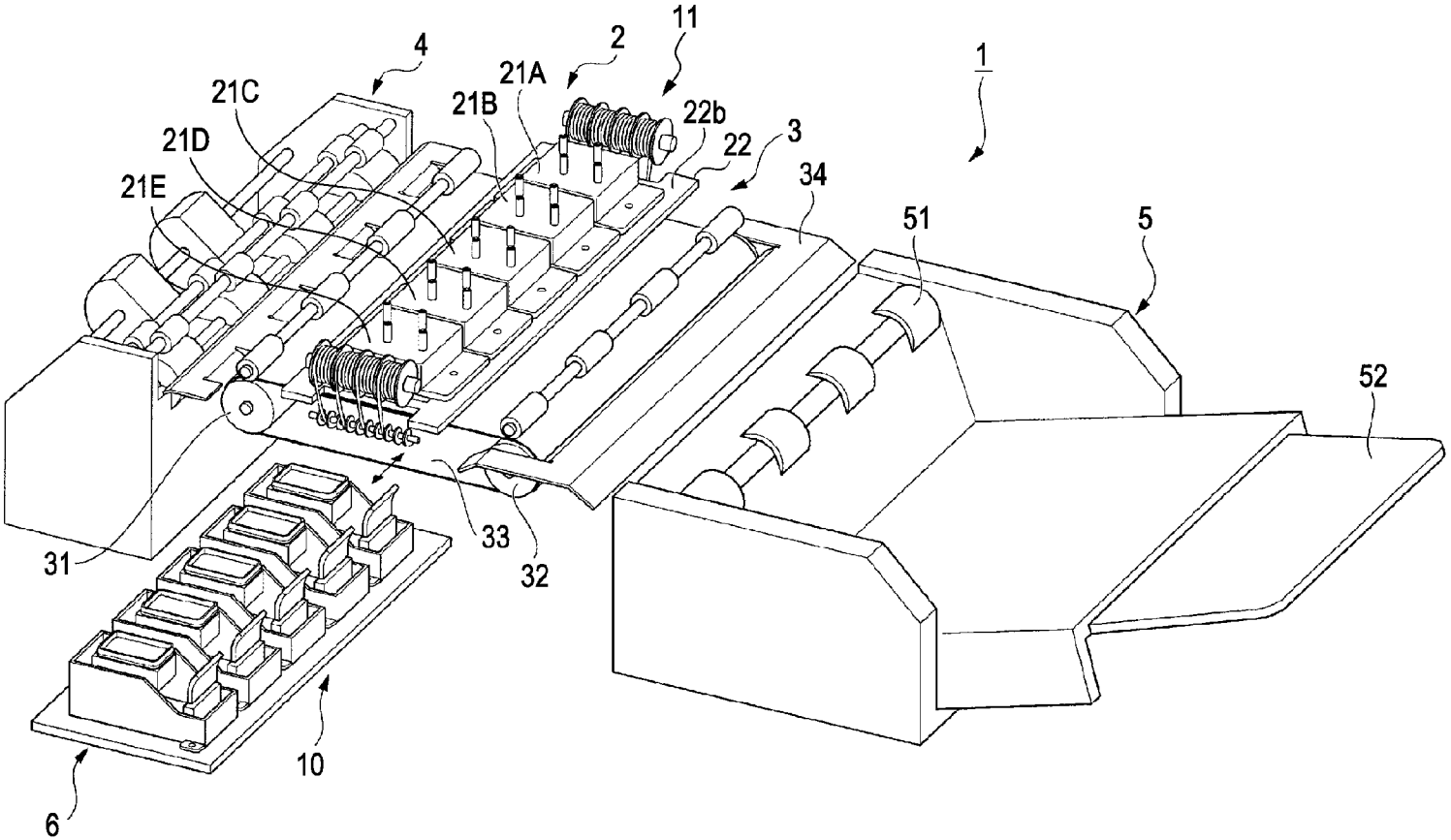
FIG. 1 is a perspective view illustrating a schematic configuration of a printer of a first embodiment.

Hereinafter, an embodiment of a fluid ejecting apparatus according to the invention will be described with reference to the accompanying drawings. Further, in the drawings below, the scales of the respective members are appropriately changed so that the respective members have recognizable sizes. Furthermore, in the description below, an ink jet printer (hereinafter, simply referred to as a printer) as an example of the fluid ejecting apparatus of the invention will be described.

First Embodiment

Figure 2:
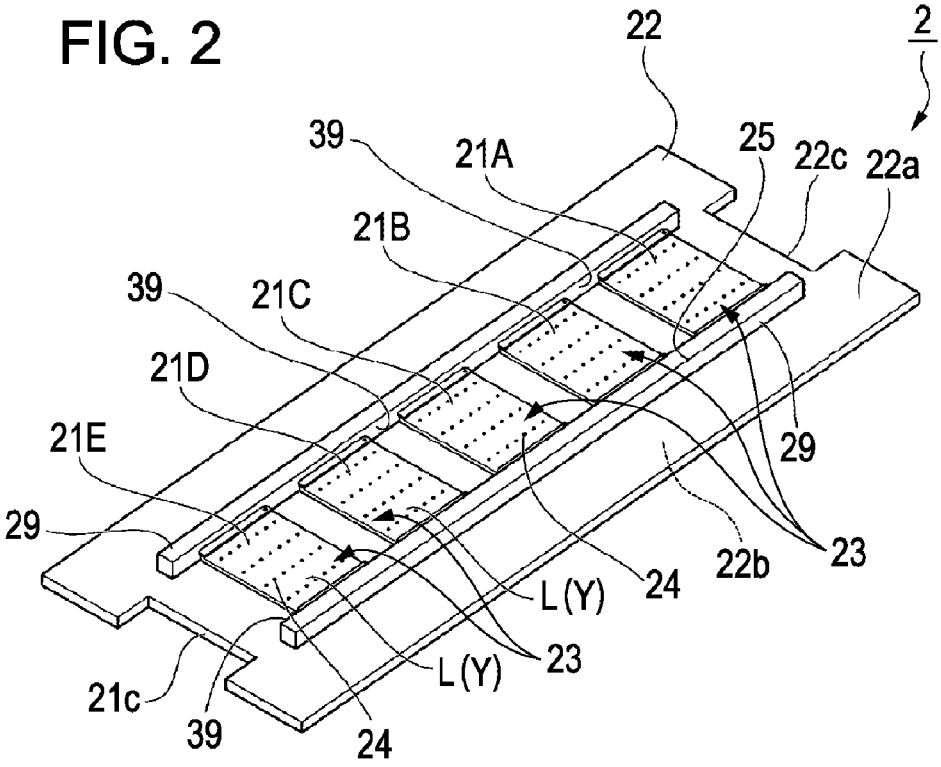
FIG. 2 is a perspective view illustrating a schematic configuration of a head unit of the first embodiment.
Figure 3:
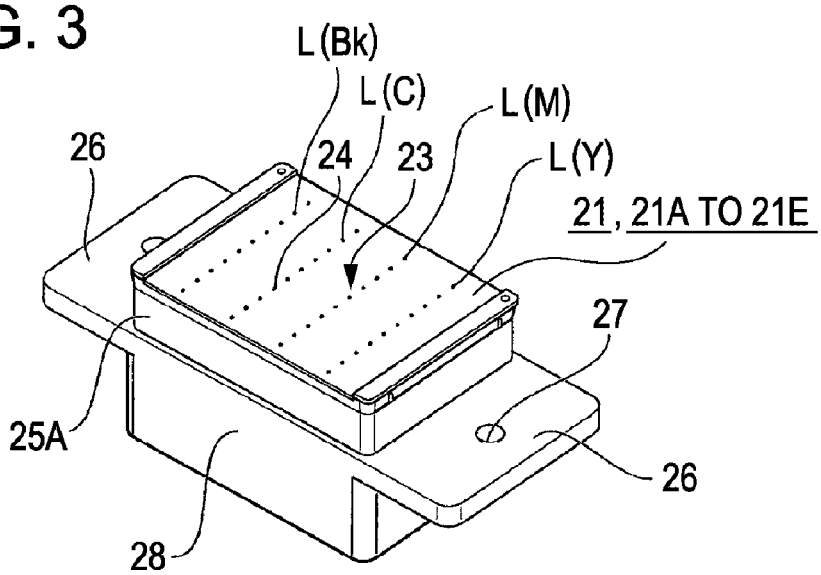
FIG. 3 is a perspective view illustrating a schematic configuration of a printing head of the first embodiment.
Figure 4:
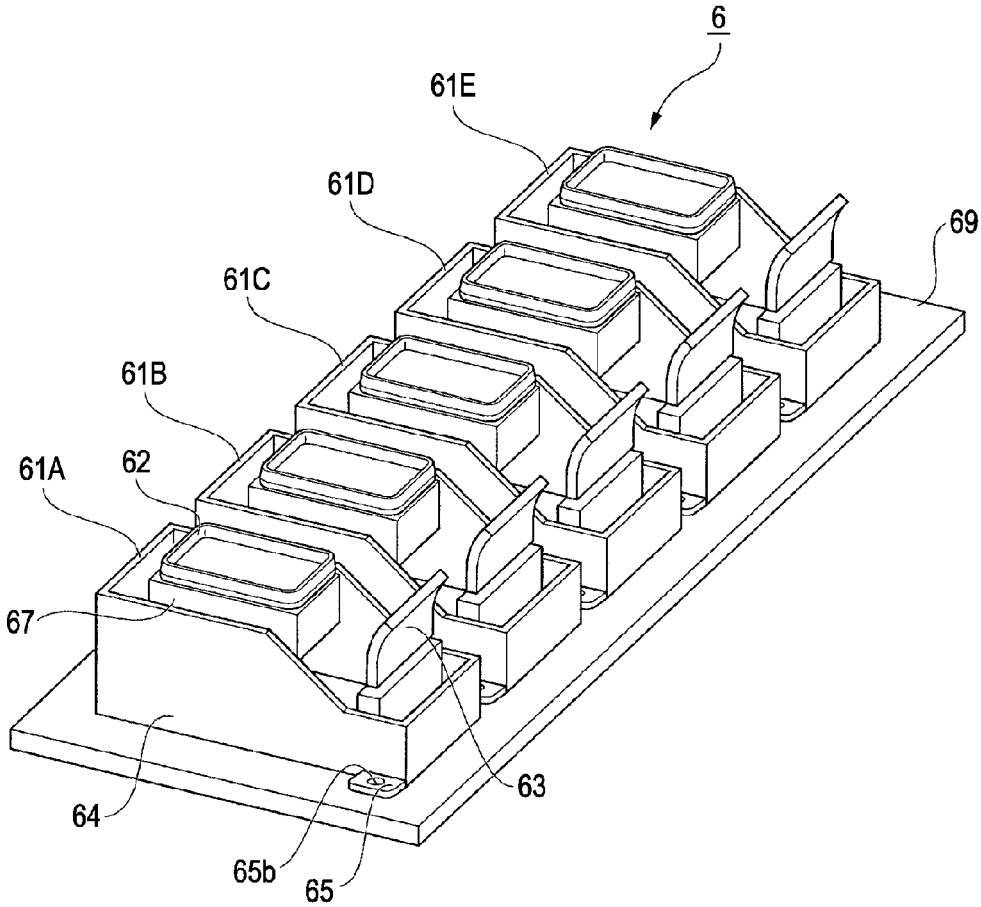
FIG. 4 is a perspective view illustrating a schematic configuration of a cap unit of the first embodiment.

FIG. 1 is a perspective view illustrating a schematic configuration of a printer, FIG. 2 is a perspective view illustrating a schematic configuration of a head unit, FIG. 3 is a perspective view illustrating a schematic configuration of a printing head constituting the head unit, and FIG. 4 is a perspective view illustrating a schematic configuration of a cap unit.

As shown in FIG. 1, a printer 1 includes a head unit 2; a transportation device 3 which transports a printing sheet (medium); a sheet feeding unit 4 which supplies the printing sheet; a sheet discharging unit 5 which discharges the printing sheet printed by the head unit 2, and a maintenance device 10 which performs a maintenance process on the head unit 2.

The transportation device 3 holds the printing sheet with a predetermined gap between the transportation device 3 and the nozzle surface 23 of each of the printing heads (fluid ejecting heads) 21 (21A, 21B, 21C, 21D, and 21E) constituting the head unit 2. The transportation device 3 includes a driving roller portion 31; a driven roller portion 32; and a transportation belt portion 33 which is constituted by a plurality of belts suspended between the roller portions 31 and 32. In addition, a holding member 34 holding the printing sheet is provided between the transportation device 3 and the sheet discharging unit 5 on the downstream side (the side of the sheet discharging unit 5) in the sheet transportation direction of the transportation device 3.

One end of the driving roller portion 31 in the rotation direction is connected to a driving motor (not shown), and is rotationally driven by the driving motor. The rotation force of the driving roller portion 31 is transmitted to the transporting belt portion 33, so that the transporting belt portion 33 is rotationally driven. If necessary, a transmission gear is provided between the driving roller portion 31 and the driving motor. The driven roller portion 32 is a so-called free roller which supports the transporting belt portion 33 and is rotated by the rotational driving operation of the transporting belt portion 33 (the driving roller portion 31).

The sheet discharging unit 5 includes a sheet discharging roller 51 and a sheet discharging tray 52 which holds the printing sheet transported by the sheet discharging roller 51.

The head unit 2 is formed by the unit of a plurality of (in the embodiment, five) printing heads (fluid ejecting heads) 21A to 21E, and inks (for example, respective inks of black B, magenta M, yellow Y, and cyan C) of a plurality of colors are ejected from the respective nozzles 24 (refer to FIG. 3) of the printing heads 21A to 21E. The printing heads 21A to 21E (hereinafter, referred to as the printing head 21) is formed as a unit while being attached to an attachment plate 22. That is, the head unit 2 of the embodiment forms a line head module in which the effective printing width of the head unit 2 is substantially equal to the transverse width (the width perpendicular to the transportation direction) of the printing sheet by a combination of the plurality of the printing heads 21 (single head member). In addition, the printing heads 21A to 21E have the same structure.

As shown in FIG. 2, the head unit 2 has a configuration in which the printing heads 21A to 21E are disposed inside an opening portion 25 formed in the attachment plate 22. Specifically, the printing heads 21A to 21E are screw-fixed to a rear surface 22*b* of an attachment plate 22 so that the nozzle surfaces 23 protrude from a front surface 22*a* of the attachment plate 22 via the opening portion 25. In addition, the head unit 2 is mounted to the printer 1 in such a manner that the attachment plate 22 is fixed to a carriage (not shown).

Further, two projection portions (the cover heads) 29 and 29 are formed on the attachment plate 22 of the head unit 2. Each of the projection portions 29 and 29 is formed as a rib-shaped member that projects from the nozzle surface 23 forming an opening end of the nozzle 24 constituting, for example, the printing head 21 toward the fluid ejection direction H and extends in the extension direction of the nozzle row L. The areas defined by the two projection portions (the cover heads) 29 and 29 form an absorbing member accommodating portion 39 to be described later. The operations of the absorbing member and the accommodating portion 39 thereof will be described later in detail.

The head unit 2 of the embodiment is adapted to be movable between a printing position and a maintenance position (in the direction depicted by the arrow of FIG. 1) by the carriage (not shown). Here, the printing position indicates a position where the head unit 2 faces the transportation device 3 and performs a printing process on the printing sheet. On the other hand, the maintenance position indicates a position where the head unit 2 retreats from the transportation device 3 and faces the maintenance device 10. The maintenance process (the suction process and the wiping process) is performed on the head unit 2 at the maintenance position.

As shown in FIG. 3, each of the printing heads 21A to 21E (hereinafter, simply referred to as the printing head 21) constituting the head unit 2 includes a head body 25A which includes the nozzle surface 23 having the nozzle rows L formed by the plurality of nozzles 24 and a support member 28 to which the head body 25A is attached.

Each of the printing heads 21A to 21E includes four nozzle rows (L(Y), L(M), L(C), and L(Bk)) respectively corresponding to four colors (yellow (Y), magenta (M), cyan (C), and black (Bk)). In each of the nozzle rows (L(Y), L(M), L(C), and L(Bk)), the nozzles 24 constituting the nozzle rows (L(Y), L(M), L(C), and L(Bk)) are arranged in the horizontal direction intersecting the transportation direction of the printing sheet, and are more desirably arranged in the horizontal direction intersecting the transportation direction of the printing sheet. Then, in the arrangement direction of the printing heads 21A to 21E, the nozzle rows L corresponding to the same colors are arranged.

The support member 28 has projection portions 26 and 26 which are formed on both sides in the length direction of the nozzle surface 23. In addition, a perforation hole 27 is formed in the projection portions 26 and 26 so as to screw-fix the printing head 21 to the rear surface 22*b* of the attachment plate 22. Accordingly, the plurality of printing heads 21 is attached to the attachment plate 22, thereby forming the head unit 2 (refer to FIG. 1).

The maintenance device 10 includes a cap unit 6 which performs a suction process on the head unit 2, and a flushing unit 11 which performs a flushing process on the head unit 2.

As shown in FIG. 4, the cap unit 6 is used to perform the maintenance process on the head unit 2, and is formed by the unit of a plurality of (in the embodiment, five) cap portions 61A to 61E respectively corresponding to the printing heads 21A to 21E. The cap unit 6 is disposed at a position distant from the printing area of the head unit 2, and herein, is disposed at a position not facing the transportation device 3.

The cap portions 61A to 61E respectively correspond to the printing heads 21A to 21E, and are adapted to come into contact with the nozzle surfaces 23 of the printing heads 21A to 21E.

Since the cap portions 61A to 61E respectively come into close contact with the nozzle surfaces 23 of the printing heads 21A to 21E, it is possible to satisfactorily perform the suction process of discharging the ink (fluid) from the nozzle surfaces 23 during the suction process.

The cap portions 61A to 61E (hereinafter, simply referred to as the cap portion 61) constituting the cap unit 6 are formed in a frame shape on the upper surfaces of the cap bodies 67 and 67, and includes a seal member 62 which comes into contact with the printing head 21, a wiper member 63 which is used for the wiping process of wiping the nozzle surface 23 of the printing head 21, and a casing 64 which integrally holds the cap body 67 and the wiper member 63.

Two (one of them is not shown) holding portions 65 holding the casing 64 using a base member 69 are formed on the bottom portion of the casing 64. The holding portions 65 are disposed at positions forming an opposite angle in the casing 64 in a plan view. Each of the holding portions 65 is provided with a perforation hole 65*b* into which a screw is inserted so as to screw-fix the casing 64 to the base member 69.

Figure 5A:
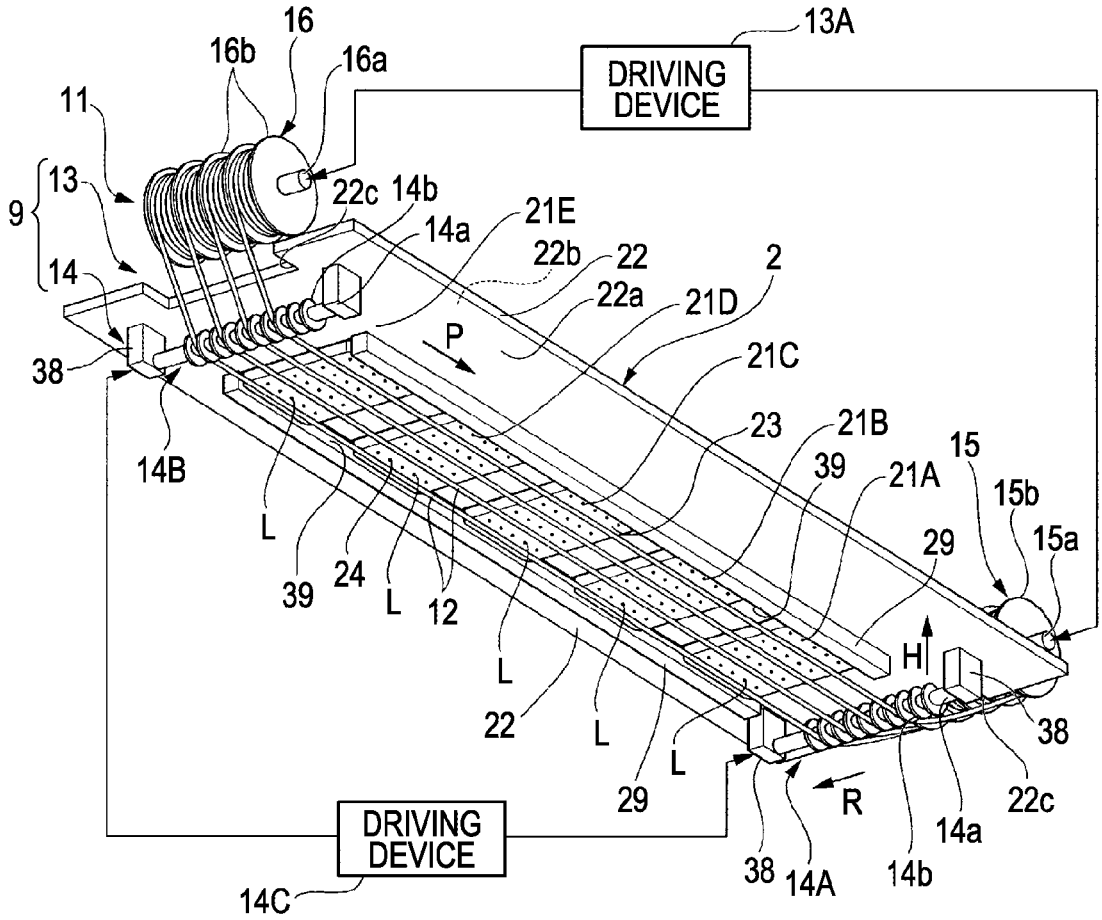
FIGS. 5A and 5B are perspective views illustrating a schematic configuration of a flushing unit of the first embodiment.
Figure 5B:
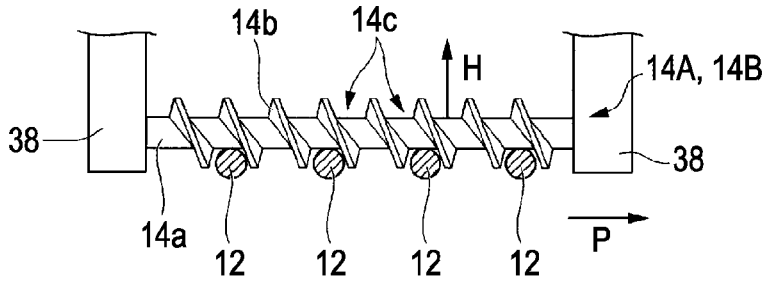

As shown in FIGS. 5A and 5B the flushing unit 11 includes a plurality of absorbing members 12 that absorbs ink droplets ejected during the flushing process and a support mechanism 9 that supports the plurality of absorbing members 12.

Next, the detailed configuration of the absorbing member 12 suitably used in the printer 1 according to this embodiment will be described.

For example, the absorbing member 12 may be formed of fiber such as SUS 304, nylon, nylon applied with a hydrophobic coating, aramid, silk, cotton, polyester, ultrahigh molecular weight polyethylene, polyarylate, or Zylon (product name), or compound fiber containing a plurality of these.

In more detail, it is possible to form the absorbing member 12 in such a manner that plural fiber bundles formed of the fiber or the compound fiber are twisted or bound.

FIGS. 5A and 5B are schematic diagrams showing an example of the absorbing member 12, where FIG. 5A is a sectional view and FIG. 5B is a plan view. As shown in FIGS. 5A and 5B, for example, the absorbing member 12 is formed in such a manner that two (plural) fiber bundles (strings) 12*a* formed of fiber are twisted. As shown in FIGS. 5A and 5B, in the case where the absorbing member 12 is formed by twisting the plural fiber bundles 12*a*, since it is possible to store ink in a valley portion 12*b* formed between the fiber bundles 12*a*, it is possible to increase an ink absorption amount of the absorbing member 12.

In addition, as an example, a linear member obtained by twisting plural fiber bundles formed of SUS 304, a linear member obtained by twisting plural fiber bundles formed of nylon, a linear member obtained by twisting plural fiber bundles formed of nylon applied with hydrophobic coating, a linear member obtained by twisting plural fiber bundles formed of aramid, a linear member obtained by twisting plural fiber bundles formed of silk, a linear member obtained by twisting plural fiber bundles formed of cotton, a linear member obtained by twisting plural fiber bundles formed of Belima (product name), a linear member obtained by twisting plural fiber bundles formed of Soierion (product name), a linear member obtained by twisting plural fiber bundles formed of Hamilon 03 T (product name), a linear member obtained by twisting plural fiber bundles formed of Dyneema hamilon DB-8 (product name), a linear member obtained by twisting plural fiber bundles formed of Vectran hamilon VB-30, a linear member obtained by twisting plural fiber bundles formed of Hamilon S-5 Core Kevlar Sleeve Polyester (product name), a linear member obtained by twisting plural fiber bundles formed of Hamilon S-212 Core Coupler Sleeve Polyester (product name), a linear member obtained by twisting plural fiber bundles formed of Hamilon SZ-10 Core Zylon Sleeve Polyester (product name), or a linear member obtained by twisting plural fiber bundles formed of Hamilon VB-3 Vectran (product name) may be suitably used as the absorbing member 12.

Since the absorbing member 12 obtained by the fiber of nylon is formed of nylon widely used as a general leveling string, the absorbing member 12 is cheap.

Since the absorbing member 12 using the metallic fiber of SUS has an excellent corrosion resistance property, it is possible to allow the absorbing member 12 to absorb a variety of ink. Also, since the absorbing member 12 has an excellent wear resistance property compared with a resin, it is possible to repeatedly use the absorbing member 12.

The absorbing member 12 using the fiber of ultrahigh molecular weight polyethylene has high breaking strength and chemical resistance, and is strong against an organic solvent, acid, or alkali. Likewise, since the absorbing member 12 using the fiber of ultrahigh molecular weight polyethylene has high breaking strength, it is possible to pull the absorbing member 12 in a high-tension state, and to prevent the absorbing member 12 from being bent. For this reason, in the case where the diameter of the absorbing member 12 is thickened so as to increase the absorbing capacity or the diameter of the absorbing member 12 is not thickened, it is possible to improve the printing precision by narrowing the distance between the printing sheet transporting region and the head 21. In addition, it is expected that the above-described advantage is obtained even in the absorbing member 12 using the fiber of Zylon or an aramid and the absorbing member 12 using the fiber of super-high-molecular polyethylene.

The absorbing member 12 using the fiber of cotton has an excellent ink absorbing property.

In the absorbing member 12, the dropped ink is accommodated and absorbed in the valley portion 12*b* (see FIGS. 5A and 5B) formed between the fiber bundle 12*a* and the fiber due to the surface tension.

In addition, a part of the ink dropped onto the surface of the absorbing member 12 directly enters into the absorbing member 12, and the rest moves to the valley portion 12*b* formed between the fiber bundles 12*a*. Further, a part of the ink entering into the absorbing member 12 gradually moves in the extension direction of the absorbing member 12 in the inside of the absorbing member 12 so as to be held therein while being dispersed in the extension direction of the absorbing member 12. A part of the ink moving to the valley portion 12*b* of the absorbing member 12 gradually enters into the absorbing member 12 through the valley portion 12 *b*, and the rest remains in the valley portion 12*b* so as to be held therein while being dispersed in the extension direction of the absorbing member 12. That is, a part of the ink dropped onto the surface of the absorbing member 12 stays at the dropped position, and the rest is dispersed and absorbed in the vicinity of the dropped position.

In addition, in fact, a material forming the absorbing member 12 provided in the printer 1 is selected in consideration of an ink absorbing property, an ink holding property, a tensile strength, an ink resistance property, formability (a generated amount of fluff or fraying), distortion, cost, or the like.

Further, the ink absorbing amount of the absorbing member 12 is the sum of the amount of ink held between the fibers of the absorbing member 12 and the amount of ink held in the valley portion 12*b*. For this reason, the material forming the absorbing member 12 is selected so that the ink absorbing amount is sufficiently larger than the amount of the ink ejected during the flushing process in consideration of the exchange frequency of the absorbing member 12.

Furthermore, the amount of ink held between the fibers of the absorbing member 12 and the amount of ink held in the valley portion 12*b* may be determined by the contact angle between the ink and the fibers, and the capillary force between the fibers depending on the surface tension of the ink. That is, when the absorbing member 12 is formed of thin fibers, the gap between the fibers increases and the surface area of the fiber increases. Accordingly, even when the sectional area of the absorbing member 12 is uniform, the absorbing member 12 is capable of absorbing a larger amount of ink. As a result, in order to obtain more gaps between the fibers, a micro fiber (ultrafine fiber) may be used as a fiber forming the fiber bundle 12*a*.

However, the ink holding force of the absorbing member 12 decreases since the capillary force decreases due to an increase in the gap between the fibers. For this reason, it is necessary to set the gap between the fibers so that the ink holding force of the absorbing member 12 is of a degree that the ink is not dropped due to the movement of the absorbing member 12.

In addition, the thickness of the absorbing member 12 is set so as to satisfy the above-described ink absorbing amount. In detail, for example, the thickness of the absorbing member 12 is set to be equal to or more than 0.3 mm and equal to or less than 1.0 mm, and more desirably about 0.5 mm.

However, in order to prevent the absorbing member 12 from coming into contact with the head 21 and the printing sheet, the thickness of the absorbing member 12 is set so that the maximum dimension of the section is equal to or less than a dimension obtained by subtracting an amount excluding the displacement amount caused by the bending of the absorbing member 12 from the distance of the sheet transporting region between the printing sheet and the head 21.

In addition, the absorbing member 12 has a width which is larger than the diameter of the nozzle by 15 to 50 times. In this embodiment, the gap between the printing sheet and the nozzle surface 23 of the printing head 21 is about 2 mm, and the nozzle diameter is about 0.02 mm. Accordingly, when the diameter of the absorbing member 12 is 1 mm or less, the absorbing member can be disposed between the nozzle surface and the printing sheet, and the ejected ink can be captured by the absorbing member even when component dimension errors are considered.

Further, it is desirable that the length of the absorbing member 12 is sufficiently long with respect to the effective printing width of the head unit 2. Although it will be described in detail, the printer 1 of the embodiment adopts a configuration in which the used area (ink absorbing state) of the absorbing member 12 is sequentially wound, and the absorbing member 12 is exchanged with a new replacement when the entire area of the absorbing member 12 absorbs the ink. For this reason, it is desirable that the exchange period of the absorbing member 12 is set to a period that the absorbing member can be used practically, and the length of the absorbing member 12 is about several hundred times larger than the effective printing width of the head unit 2. However, when the absorbing member 12 is recycled by performing a cleaning process or the like in the printer 1, the length of the absorbing member 12 may be about twice as long as the effective printing width of the head unit 2.

The absorbing member 12 is suspended (supported) by the support mechanism 9.

The support mechanism 9 includes a movement mechanism 13 (a second movement section) and a movement mechanism 14 (a first movement section). The support mechanism 9 is substantially integrated with the head unit 2.

The movement mechanism 14 is adapted to move the absorbing member 12 between the flushing position facing the nozzle 24 and the retreat position not facing the nozzle 24 by moving the absorbing member 12 in a direction (in the embodiment, perpendicular to) intersecting the extension direction of the nozzle row. Further, the movement mechanism 13 is adapted to move the absorbing member 12 in the extension direction by winding the absorbing member 12. As shown in FIGS. 1 and 5A, the movement mechanism (second movement mechanism) 13 includes rotation portions 15 and 16 (rotation bodies) which are respectively provided on the side of the rear surface 22*b* of the attachment plate 22 (the opposite side of the nozzle surfaces 23 of the heads 21A to 21E) on both sides of the head unit 2 in the nozzle row direction so that their rotation shafts are aligned with the transportation direction of the printing sheet. The rotation portions 15 and 16 are winding mechanisms which are formed in a bobbin shape by rotation shafts 15*a* and 16*a* and a plurality of (herein, five) partition plates 15*b* and 16*b* disposed on the rotation shafts 15*a* and 16*a* at the same interval, and are used to move four absorbing members 12 in the extension direction by winding each of the absorbing members 12 between the partition plates 15*b* and 16*b* about the rotation shafts 15*a* and 16*a*. Accordingly, since the absorbing member 12 is wound and moved, it is possible to collect the absorbing member 12 while moving the absorbing member 12. Accordingly, it is possible to easily exchange the absorbing member 12 just by exchanging the rotation portions 15 and 16 after the absorbing member 12 is completely wound.

As shown in FIGS. 5A and 5B, the movement mechanism 13 includes a driving device 13A that rotationally drives the rotation portions 15 and 16. Then, the rotation portions 15 and 16 are connected to the driving device 13A, and are used to supply and wind the plurality of absorbing members 12 by the rotation thereof. In the embodiment, one rotation portion 15 is used to supply the absorbing member, and the other rotation portion 16 is used to wind the absorbing member in accordance with the rotation thereof.

Accordingly, in the printer 1 of the embodiment, the movement mechanism 13 moves the absorbing member 12 in the extension direction in accordance with the rotational driving of the rotation portions 15 and 16.

As shown in FIGS. 5A and 5B, the movement mechanism (the first movement mechanism) 14 includes a pair of movement members 14A and 14B, each of which is formed by winding a projection portion 14*b* in a spiral shape on a shaft portion 14*a*, and vertical movement members 38 which respectively hold the shaft portions 14*a* of the movement members 14A and 14B and move the movement members 14A and 14B in the ejection direction H of the fluid ejected from the nozzle 24.

The movement members 14A and 14B have a configuration in which each of the absorbing members 12 is held inside a guide groove 14*c* formed by the shaft portion 14*a* and the projection portion 14*b*. The movement mechanism 14 is disposed on the side of the front surface 22*a* of the attachment plate 22 (the nozzle surfaces 23 of the printing heads 21A to 21E) on both sides of the head unit 2 in the nozzle row direction. The plurality of absorbing members 12 wound on the rotation portions 15 and 16 of the movement mechanism 13 is suspended on the movement members 14A and 14B. Then, the end portion of the guide groove 14*c* in the vertical direction of the nozzle surface 23 is located at a position distant from the nozzle surface 23 with respect to the nozzle surface 23. For this reason, it is possible to hold the absorbing members 12 suspended on the movement members 14A and 14B without contacting the nozzle surfaces 23 of the printing heads 21A to 21E.

On the other hand, the vertical movement member 38 constituting the movement mechanism (the first movement mechanism) 14 may be formed as a member such as a cam or a rack that is movable linearly so as to vertically move the movement members 14A and 14B in the ejection direction H for every shaft portion 14*a*. By using the vertical movement member 38, the absorbing member 12 is vertically moved between the position away from the nozzle surface 23 and the position close to the nozzle surface 23. In addition, the vertical movement member 38 may be formed as a member capable of changing the relative position between the absorbing member 12 and the printing head (the fluid ejecting head) 21.

In addition, as shown in FIGS. 5A and 5B, the movement mechanism 14 includes a driving device 14C that drives the movement members 14A and 14B and the vertical movement member 38. As described above, the absorbing member 12 moves in the extension direction P of the nozzle row L between the position overlapping with the nozzle row L, that is, the position receiving (absorbing) the ejected fluid (ink droplet) and the position not overlapping with the nozzle row L when the movement members 14A and 14B rotate once. In addition, the absorbing member 12 moves in the ejection direction H of the fluid between the position away from the nozzle surface 23 and the position close to or contacting the nozzle surface 23 by the vertical movement member 38.

By using the operations of both the movement members 14A and 14B and the vertical movement member 38, the absorbing member 12 is movable between two operation positions, that is, the flushing position (refer to FIGS. 6A and 6B) where the absorbing member 12 overlaps with the nozzle row L and away from the nozzle surface 23 by a predetermined distance and the retreat position (refer to FIGS. 7A and 7B) where the absorbing member does not overlap with the nozzle row L and is accommodated inside the accommodating portion 39 defined by the projection portions (the cover heads) 29 and 29 while being close to or contacting the nozzle surface 23.

In the flushing position (refer to FIGS. 6A and 6B), the absorbing members 12 respectively face the plurality of corresponding nozzle rows L (the plurality of nozzles 24 constituting the nozzle rows L) while maintaining a flight distance of a predetermined ink droplet Q, and are capable of absorbing the ink droplets ejected from the nozzle rows L during the flushing process.

On the other hand, in the retreat position (refer to FIGS. 7A and 7B), the absorbing members 12 are accommodated in the accommodating portion 39 defined by the projection portions (the cover heads) 29 and 29 while not facing the nozzle rows L (the plurality of nozzles 24 constituting the nozzle rows L), and the ink droplet Q ejected from the nozzle 24 can be ejected to the medium (the printing sheet) Z.

The absorbing member 12 suspended between the movement members 14A and 14B passes through notch portions 22*c* and 22*c* provided in the attachment plate 22, and is suspended on the rotation portions 15 and 16, where the absorbing member is prevented from contacting the attachment plate 22. Accordingly, the movement of the absorbing member 12 is smooth.

Then, since the driving device 13A controls the rotation speed of the rotation portions 15 and 16, the support mechanism 9 holds the plurality of absorbing members 12 supported by the movement mechanisms 13 and 14 in an appropriate tension state without bending the absorbing members. Accordingly, it is possible to prevent the absorbing member 12 from being bent to thereby contact the nozzle surface 23 or the printing sheet.

In this support mechanism 9, since the plurality of absorbing members 12 are supported by the rotation portions 15 and 16 disposed on the rear surface 22*b* of the attachment plate 22 in the head unit 2 and the movement members 14A and 14B disposed on the front surface 22*a* of the attachment plate 22, the absorbing members 12 supplied from the rotation portions 15 are wound on the rotation portion 16 via the position above the nozzle surfaces 23 of the printing heads 21A to 21E. For this reason, the absorbing members 12 move in the extension direction of the nozzle rows L of the head unit 2, that is, the direction R intersecting the transportation direction of the printing sheet, in accordance with the rotation of the rotation portion 15 and 16.

In addition, when the movement members 14A and 14B are rotated by the driving device 14C, the plurality of guide grooves 14*c* formed by the shaft portion 14*a* and the projection portion 14*b* apparently move in the axial direction. Accordingly, it is possible to change the positions of the absorbing members 12 with respect to the head unit 2 (the nozzle row L). Specifically, it is possible to move the absorbing member 12 in the direction R intersecting the extension direction P of the nozzle rows L of the head unit 2, that is, the transportation direction of the printing sheet.

Further, when the vertical movement member 38 is driven by the driving device 14C, the movement members 14A and 14B are moved vertically in the ejection direction H. Accordingly, the absorbing member 12 moves in the ejection direction H of the fluid between the position away from the nozzle surface 23 and the position close to or contacting the nozzle surface 23, that is, the position where the absorbing member is accommodated inside the accommodating portion 39 defined by the projection portions 29 and 29.

By the operations of the movement members 14A and 14B and the vertical movement member 38, the absorbing member 12 moves between the flushing position (refer to FIGS. 6A and 6B) and the retreat position (refer to FIGS. 7A and 7B) in the embodiment.

Figure 7A:
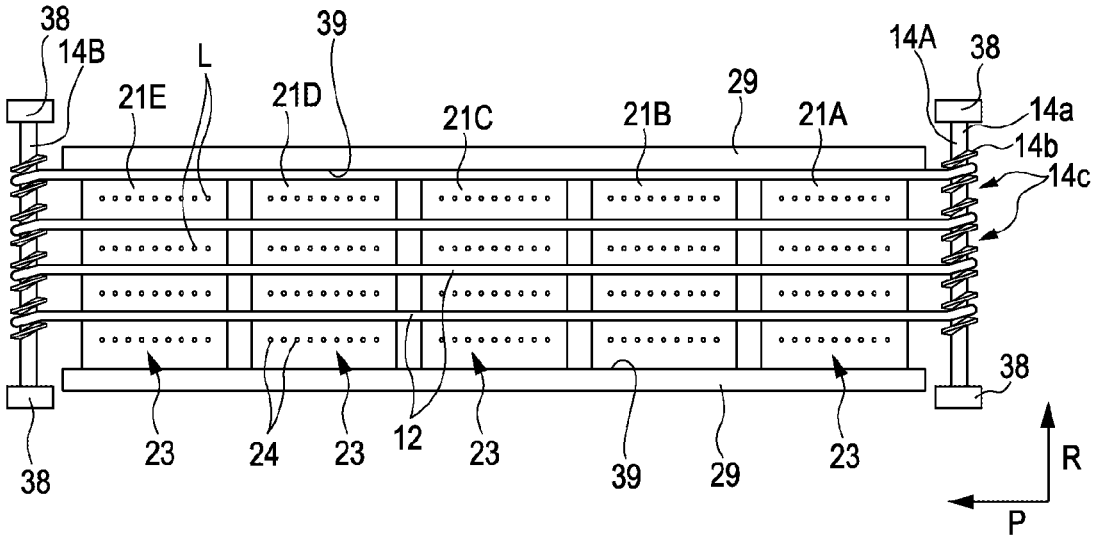
FIG. 7A is a plan view illustrating a retreat position of the absorbing member of the first embodiment.
Figure 7B:
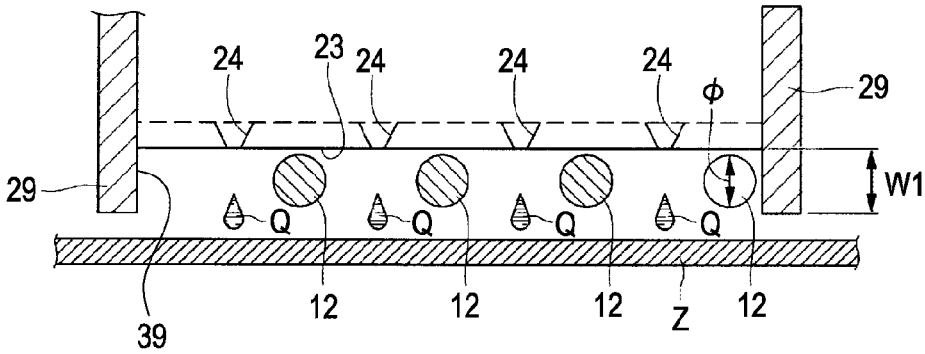
FIG. 7B is a cross-sectional view illustrating the same.

Here, as shown in FIGS. 7A and 7B, in the projection portion (the cover head) 29 protruding from the nozzle surface 23 in the ejection direction H, it is desirable that the projection height W1 from the nozzle surface 23 is equal to or larger than the diameter $\phi$ in the cross-section of the absorbing member 12. When the diameter of the absorbing member 12 is set to 1 mm, the projection height W1 of the projection portion 29 may be formed to be 1 to 1.5 mm or so. Accordingly, as shown in FIGS. 7A and 7B, the entire absorbing member 12 is accommodated in the accommodating portion 39 at the retreat position.

Accordingly, since the absorbing member 12 is accommodated inside the accommodating portion 39 at the retreat position, it is possible to suppress the occurrence of jamming caused by the contact between the printing sheet and the absorbing member 12 when performing a printing process on the medium. In addition, since the medium does not contact the absorbing member 12 having the fluid (ink) absorbed thereto during the flushing process, it is possible to prevent the medium from being contaminated.

In addition, in the embodiment, the projection portion (the cover head) 29 is formed to uniformly extend throughout the entire area of the printing heads 21A to 21E. However, for example, the projection portion 29 may be intermittently formed only at the portion where the nozzle row is present or at an arbitrary area.

On the other hand, in the movement members 14A and 14B, when the diameter of the absorbing member 12 is set to 1 mm, the absorbing member 12 may move by, for example, 1 mm in the extension direction P of the nozzle row even when there is a component dimension error or an arrangement error. If the gap between the projection portions 14*b* is set to 1 mm, the absorbing member moves by 1 mm when the movement member rotates once. Accordingly, it is possible to easily move the plurality of absorbing members 12 with high precision. Also, since the absorbing members 12 move only by 1 mm, the time taken for the movement may be short. In addition, the distance between the printing head 21 and the printing sheet is 2 mm, and the absorbing member 12 is disposed therebetween with an appropriate tension. Accordingly, it is not necessary to move the printing head 21 and the printing sheet during the movement.

Further, in FIG. 1, only a pair of the head module 2, the maintenance device 10, and the flushing unit 12 is shown. However, in fact, another pair of the head module 2, the maintenance device 10, and the flushing unit 12 is disposed in the transportation direction of the printing sheet. These two pairs have the same mechanical configuration, but are disposed while being deviated from each other in the horizontal direction (the extension direction of the heads 21A to 21E) intersecting the transportation direction of the printing sheet. More specifically, when seen from the transportation direction of the printing sheet, the heads 21A to 21E included in the head module 2 of the second pair are disposed between the heads 21A to 21E included in the head module 2 of the first pair.

Accordingly, since the two pairs of the head module 2, the maintenance device 10, and the flushing unit 12 are disposed while being deviated from each other in the horizontal direction intersecting the transportation direction of the printing sheet, the heads 21A to 21E are disposed in zigzag as a whole, and the ink can be ejected to the entire area of the effective printing width.

Figure 8:
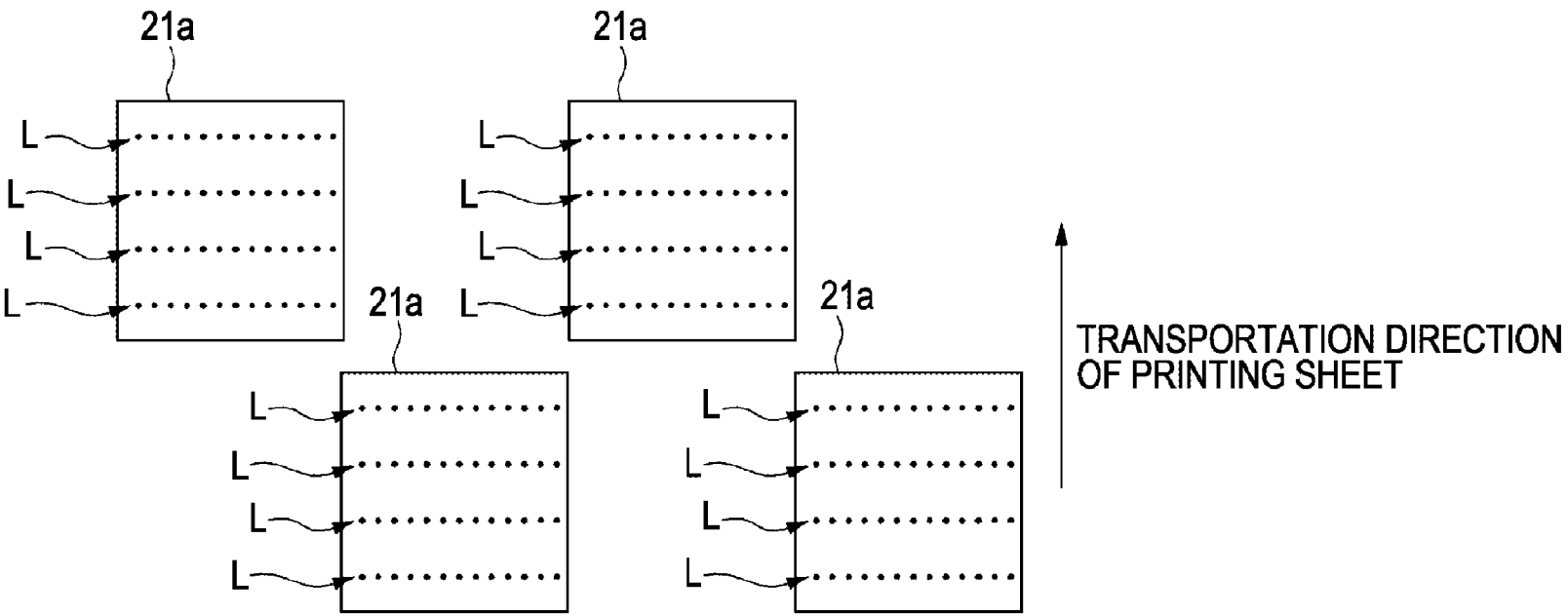
FIG. 8 is a plan view illustrating another arrangement example of the printing head.

For example, when the plurality of heads 21A is disposed in zigzag as shown in FIG. 8, the plurality of nozzle rows is disposed at the same position in the extension direction of the nozzle row (the transportation direction of the printing sheet). However, since the plurality of nozzle rows disposed at the same position in the extension direction of the nozzle rows is set to one nozzle row during the flushing process, it is possible to perform the flushing process in accordance with the same control as that of the above-described embodiment.

In the printer 1 with the above-described configuration, the ink is not ejected from all nozzles 24 while the ink is ejected from the heads 21A to 21E to the printing sheet to perform the printing process thereon. For this reason, since the ink of the nozzle 24 that does not eject the ink is dried, the viscosity of the ink increases. When the viscosity of the ink increases, a desired amount of the ink cannot be ejected. For this reason, the flushing process of ejecting the ink to the absorbing member 12 is periodically performed so as to prevent the viscosity of the ink from increasing.

Then, the absorbing member 12 included in the printer 1 of the embodiment is located at the retreat position where the absorbing member does not overlap with the position below the nozzle 24 and is accommodated in the accommodating portion 38 when performing the printing process on the printing sheet, and is located at the flushing position directly below the nozzle 24 when performing the flushing process. That is, since the absorbing member 12 is located directly below the nozzle 24 when performing the flushing process, the printing process cannot be performed. Accordingly, it is necessary to stop the printing process. For this reason, it is desirable to perform the flushing process on the transported printing sheet when the gap between the printing sheets is located directly below the nozzle. In a so-called line head printer as in the printer 1 of the embodiment, since the printing process is performed on about 60 sheets per minute, the gap between the printing sheets is located directly below the nozzle every five seconds.

Accordingly, in the printer 1 of the embodiment, for example, the flushing process is performed every five or ten seconds.

In addition, in the case where the printing process is continuously performed on a plurality of printing sheets, the time that the gap between the printing sheets is located directly below the nozzle 24 is short. In the existing printer, the movement of the absorbing member or the head unit is large during the flushing process. For this reason, in the existing printer 1, the flushing process cannot be completed within a short time, the transportation of the printing sheet is temporarily stopped, and the stop time reduces the number of printing sheets per hour. On the contrary, in the printer 1 of the embodiment, even when the absorbing member 12 moves within a narrow area in the vicinity of the heads 21A to 21E in a plan view, it is possible to switch the printing process and the flushing process. Accordingly, the flushing process may be completed while the gap between the printing sheets is located directly below the nozzle 24 or the transportation of the printing sheet may be stopped for an extremely short time for the flushing process.

Next, the operation of the printer 1 of the embodiment related to the above-described flushing process will be described with reference to the flowchart shown in FIG. 10 and the main cross-sectional views showing the operation of the flushing unit shown in FIGS. 6A, 6B, 7A, 7B, and 11. In addition, the operation of the printer 1 of the embodiment is controlled by a control device (not shown).

The printer 1 starts the flushing process on the basis of a predetermined command.

Figure 6A:
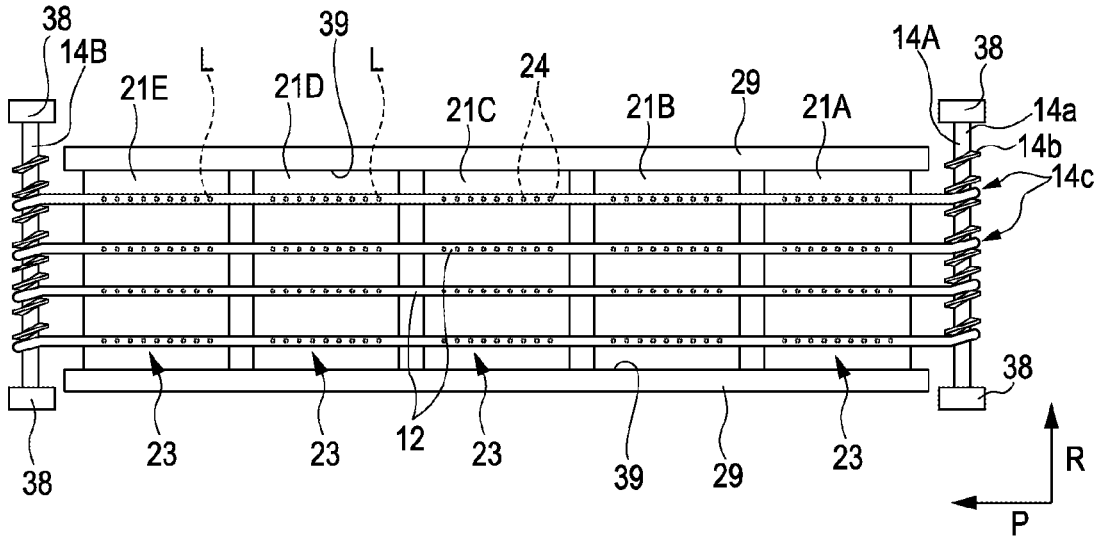
FIG. 6A is a plan view illustrating a flushing position of an absorbing member of the first embodiment.
Figure 6B:
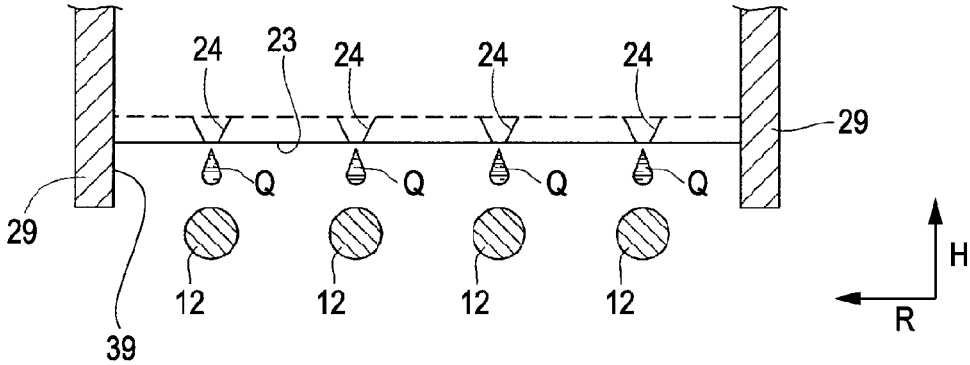
FIG. 6B is a cross-sectional view illustrating the same.
Figure 9A:
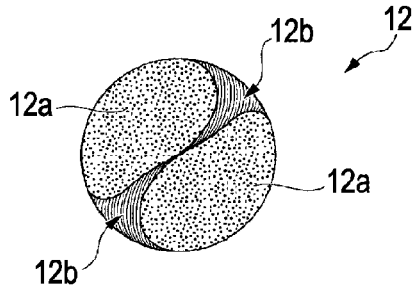
FIGS. 9A and 9B are schematic diagrams illustrating the absorbing member included in the printer of the first embodiment.
Figure 9B:
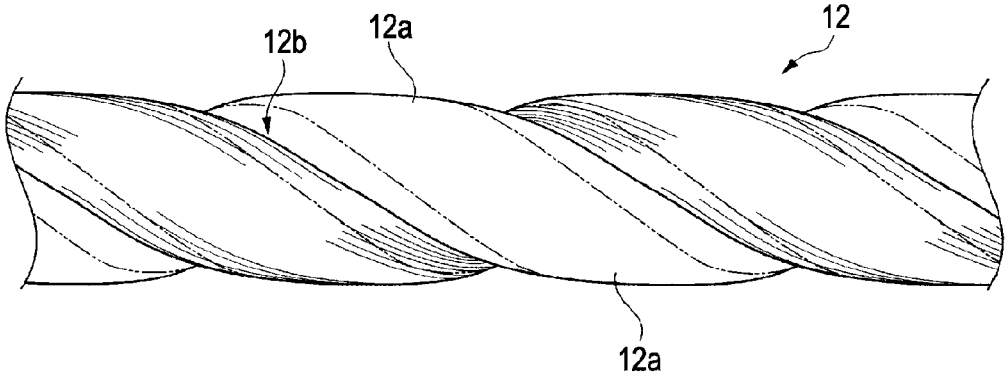
Figure 10:
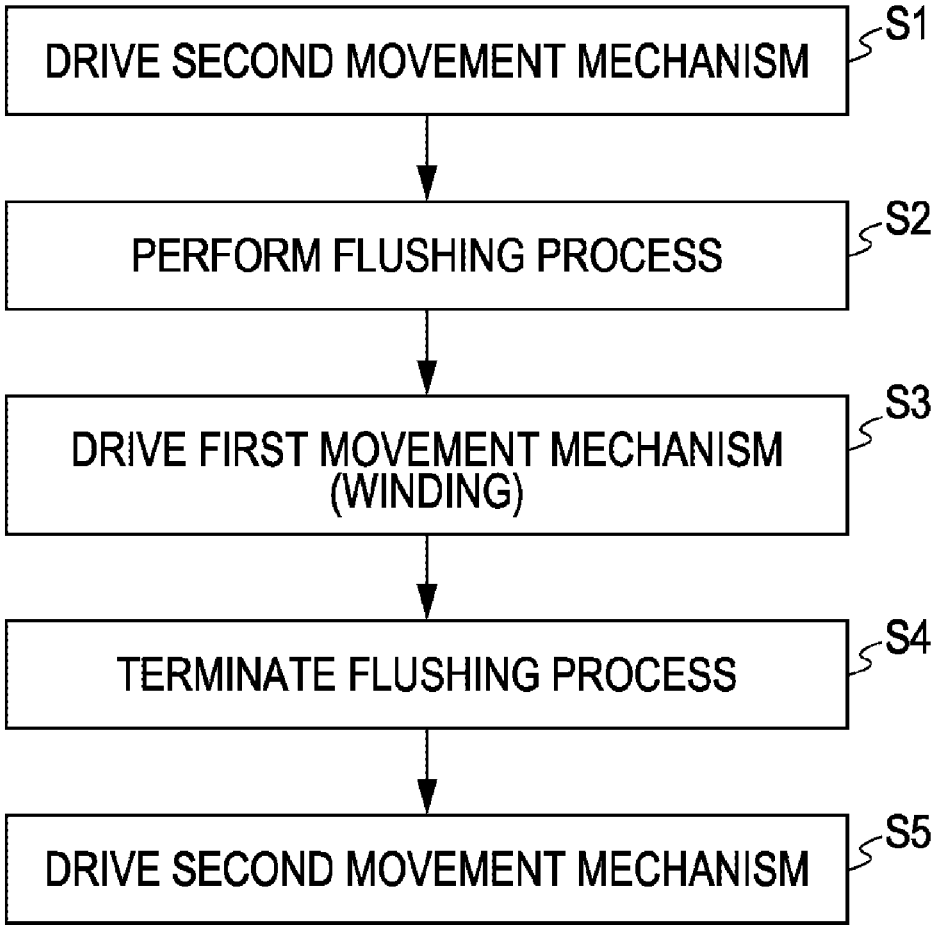
FIG. 10 is a flowchart illustrating an operation of the printer of the first embodiment.
Figure 11:
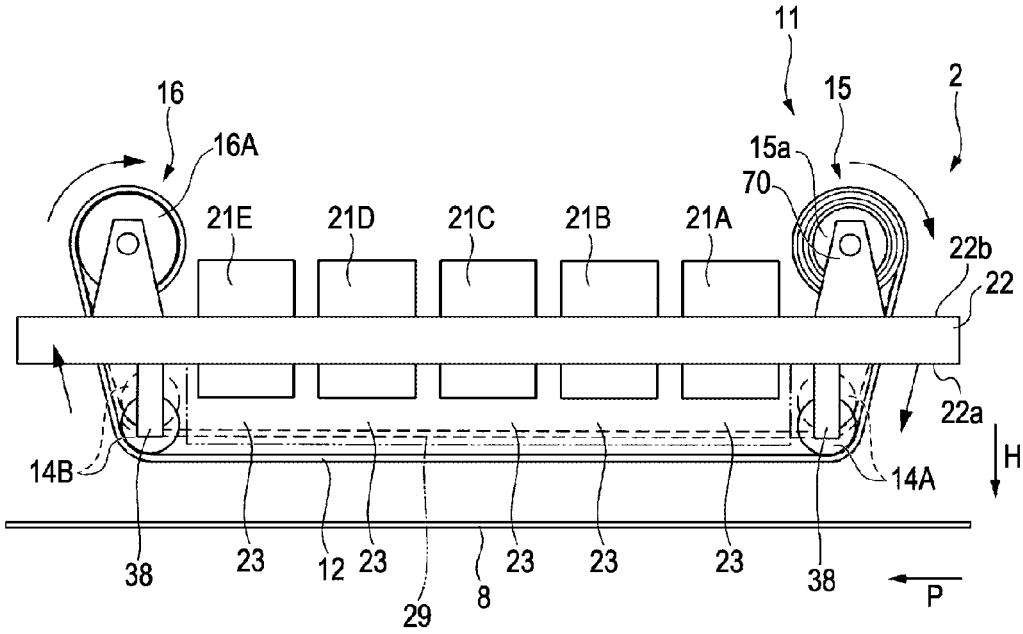
FIG. 11 is a cross-sectional view illustrating an operation of a main part of the printer of the first embodiment.

First, the movement mechanism (the first movement mechanism) 14 shown in FIG. 11 is driven (FIG. 10: S1), and the plurality of supported absorbing members 12 is moved to the flushing position as shown in FIGS. 6A and 6B. Specifically, when the movement members 14A and 14B are moved by the vertical movement member 38 in the direction away from the nozzle surface 23 in the ejection direction H while the movement members 14A and 14B are rotated in the normal direction by a predetermined number of revolutions (in the embodiment, one revolution), the absorbing members 12 respectively face the nozzle rows L of the printing heads 21A to 21E with a predetermined gap therebetween. At this time, the absorbing members 12 respectively face the plurality of nozzle rows L arranged in the extension direction of the printing heads 21A to 21E as shown in FIGS. 9A and 9B.

With such a configuration, it is possible to respectively dispose four absorbing members 12 on the ink ejection direction of each of the nozzle rows L.

Subsequently, the control device performs the flushing process on the head unit 2 (S2 in FIG. 8) so as to eject ink droplets (for example, 10 droplets) from the nozzle rows L (the nozzles 24) of the printing head 21 to the absorbing members 12. The ink droplets ejected from the nozzle rows L are absorbed by the absorbing members 12.

The control device drives the moving mechanism 13 and moves each of the absorbing members 12 in a direction depicted by the arrow in FIGS. 9A and 9B during a time when the flushing process is performed on the head unit 2 so as to perform an operation of winding the ink absorbing portion of the absorbing member 12 (S3 in FIG. 8). That is, in the printer 1 according to this embodiment, the moving mechanism 13 moves the absorbing member 12 in the extension direction during the flushing process under the control of the control device. Accordingly, since the ink droplets ejected from the nozzle rows L are ejected onto a new portion not containing the ink of the absorbing member 12, the ink droplets are reliably and rapidly absorbed into the absorbing member 12.

In addition, in the case where the maximum dimension of the section of the absorbing member 12 is reliably 75 times larger than the diameter of the nozzle, the ink absorbing amount of the absorbing member 12 very increases. For this reason, it is not necessary to perform the operation of winding the absorbing member 12 while performing the flushing process. For example, in the case where the ink is not dropped even when 100 droplets of ink are ejected onto the same position of the absorbing member 12, a new portion of the absorbing member 12 may be supplied after performing the flushing process 10 times.

That is, in the printer 1 according to this embodiment, the moving mechanism 13 may move the absorbing member after performing the flushing process plural times. Accordingly, the same region of the absorbing member 12 is used to receive the ink droplets plural times, and hence the absorbing member 12 is capable of absorbing a large amount of ink.

In this embodiment, the moving mechanism 13 controls the winding speed of the absorbing member 12 in accordance with the amount of ejected ink. When the amount of ejected ink is large, the winding speed increases so that the absorbing member 12 is not saturated, and the absorbing member 12 is wound at a high speed so as to prevent a case where the ink is not absorbed.

When the flushing process ends (S4), the control device drives the movement mechanism 14 so as to move the plurality of absorbing members 12 to the retreat position as shown in FIGS. 6A and 6B (S5).

Specifically, when the movement members 14A and 14B are rotated in the reverse direction by a predetermined number of revolutions, and the movement members 14A and 14B are moved in a direction close to the nozzle surface 23 in the ejection direction H by the vertical movement member 38, each of the absorbing members 12 is accommodated inside the accommodating portion 39 defined by the projection portions (the cover heads) 29 and 29 while not facing the nozzle row L (the plurality of nozzles 24 constituting the nozzle row L). In the retreat position, the ink droplet Q ejected from the nozzle 24 can be ejected to the medium (the printing sheet) Z.

In addition, the above-described winding operation may be performed after the retreat operation.

Subsequently, the control device restarts the printing process performed on the printing sheet.

Then, after performing the flushing process plural times during the printing process, when most of the absorbing member 12 wound around the rotation portion 15 of the moving mechanism 13 is wound around the rotation portion 16, and the absorbing member 12 cannot be supplied any more to the rotation portion 16, the absorbing member 12 is exchanged with new one. As shown in FIGS. 9A and 9B, since the moving mechanism 13 according to this embodiment is separably attached to the rear surface 22*b* of the attachment plate 22 through the attachment member 70, it is possible to easily exchange the absorbing member 12.

According to this embodiment, since the linear absorbing member 12 is disposed between the printing sheet 8 and the printing head 21, and the linear absorbing member 12 is moved so as to face the nozzle of the printing head 21 and to absorb ink during the flushing process, it is possible to perform the flushing process without moving the head unit 2. Since it is not necessary to move the head unit 2, it is possible to rapidly perform the flushing process at the appropriate timing.

Then, in the retreat position where the flushing process is not performed, since the absorbing member 12 is accommodated inside the accommodating portion 39 defined by the projection portions (the cover heads) 29 and 29, it is possible to suppress the occurrence of a jam caused by the contact between the absorbing member 12 and the medium during the printing process performed on the medium. In addition, since the absorbing member 12 having the fluid (the ink) absorbed thereto does not contact the medium during the flushing process, it is possible to prevent the medium from being contaminated.

Further, since the linear member is used as the absorbing member 12, it is possible to prevent a rising air stream from being generated in the vicinity of the absorbing member 12 and to prevent the ink from being attached to the head 21 when the ink is dropped onto the absorbing member 12. For this reason, it is possible to move the absorbing member 12 to be close to the head 21, and to suppress the occurrence of mist caused by the volatilization of ink and contaminating the head 21 or the like.

Furthermore, since the ejection target is the linear absorbing member 12 during the flushing process, the dot omission hardly occurs due to the influence of wind pressure generated upon ejecting ink to the absorbing member 12. In addition, since all the ink droplets ejected during the flushing process are absorbed by the absorbing member 12 in the vicinity of the nozzle 24, it is possible to prevent the printing sheet or the transporting belt portion 33 from being contaminated.

Moreover, since the winding speed of the absorbing member 12 is changed in accordance with the amount of ejected ink, it is possible to perform the operation of winding the absorbing member 12 during a time when the absorbing member 12 is not saturated by the ink. Accordingly, it is possible to reliably absorb the ink into the absorbing member 12 without omitting the ink during the flushing process.

As described above, in this embodiment, since it is possible to rapidly perform the flushing process with a simple configuration, it is possible to improve the printing performance.

Further, in the above-described embodiment, the absorbing member 12 is moved in the ejection direction by the vertical movement member 38 so that the absorbing member 12 overlaps with the nozzle 24 while maintaining a predetermined gap (a flight distance of the ink) from the opening end thereof at the flushing position. This is because the opening end of the nozzle 24 is blocked by the absorbing member 12 if the flushing process is performed when the absorbing member 12 is located at a position overlapping with the nozzle 24 while the absorbing member 12 is close to or contacts the nozzle surface 23. For this reason, the fluid may fly in the reverse direction.

When the depth of the accommodating portion 39, that is, the height from the nozzle surface 23 of the projection portion (the cover head) 29 is sufficiently larger than the diameter of the absorbing member 12, the absorbing member 12 does not protrude from the upper end of the projection portion 29 even at the retreat position, and the gap between the absorbing member 12 and the nozzle surface 23 can be maintained, a structure may be adopted in which the vertical movement member 38 is not provided and the absorbing member is not moved in the ejection direction when moving the absorbing member 12 from the retreat position to the flushing position.

Further, in the above-described embodiment, the absorbing member 12 is frequently wound during the flushing process, but when the absorbing member 12 does not need to be wound due to a small amount of ejected ink, the absorbing member 12 may be stopped.

Furthermore, the movement mechanism 14 may include a position adjustment mechanism that adjusts the position of the absorbing member 12 in the direction perpendicular to the nozzle row L. Accordingly, it is possible to reliably move the absorbing member 12 to the position facing the nozzle row L, and to reliably retreat the absorbing member 12 to the position not facing the nozzle row L.

Moreover, when a narrow tape-like member (cloth or the like) is used as the absorbing member, it is possible to satisfactorily seal the nozzle surface 23 even when the absorbing member is interposed between the printing head 21 and the cap portion 61.

Second Embodiment

The basic configuration of the ink jet printer of the second embodiment shown below is substantially the same as that of the first embodiment, but the configuration of the flushing unit is different. Accordingly, in the description below, the differences from the above-described embodiment will be described in detail, and the description of the similarities will be omitted. Further, in the respective drawings used for the description below, the same reference numerals will be given to the same components as those of FIGS. 1 to 11.

Figure 12:
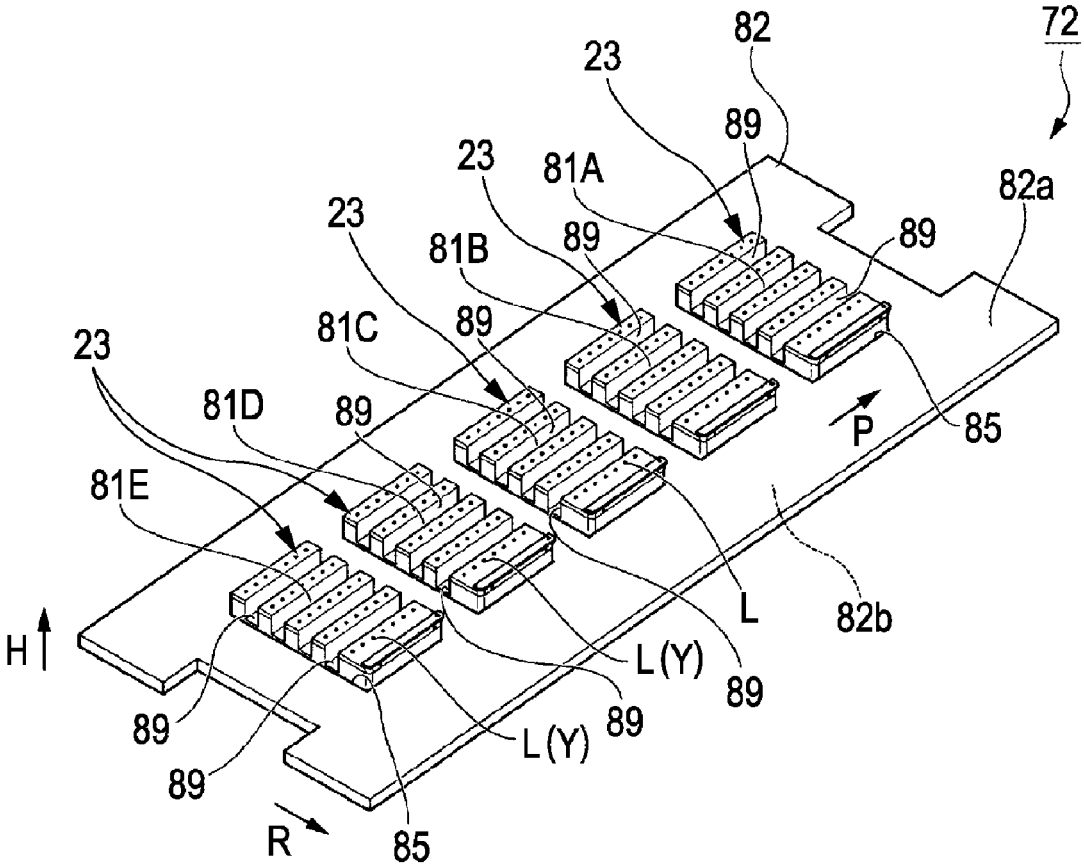
FIG. 12 is a perspective view illustrating a schematic configuration of a head unit of a second embodiment.
Figure 13A:
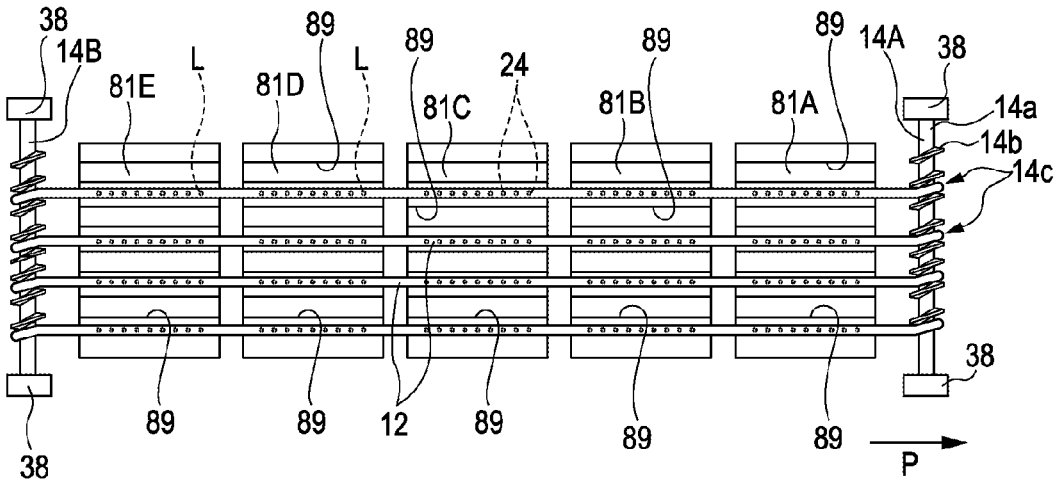
FIG. 13A is a plan view illustrating a flushing position of an absorbing member of the second embodiment.
Figure 13B:
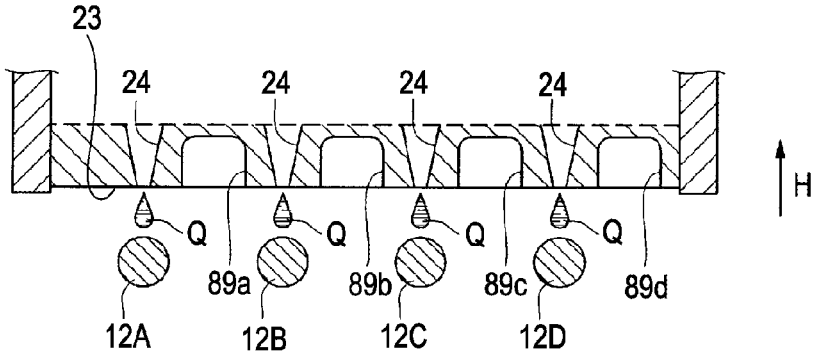
FIG. 13B is a cross-sectional view illustrating the same.
Figure 14A:
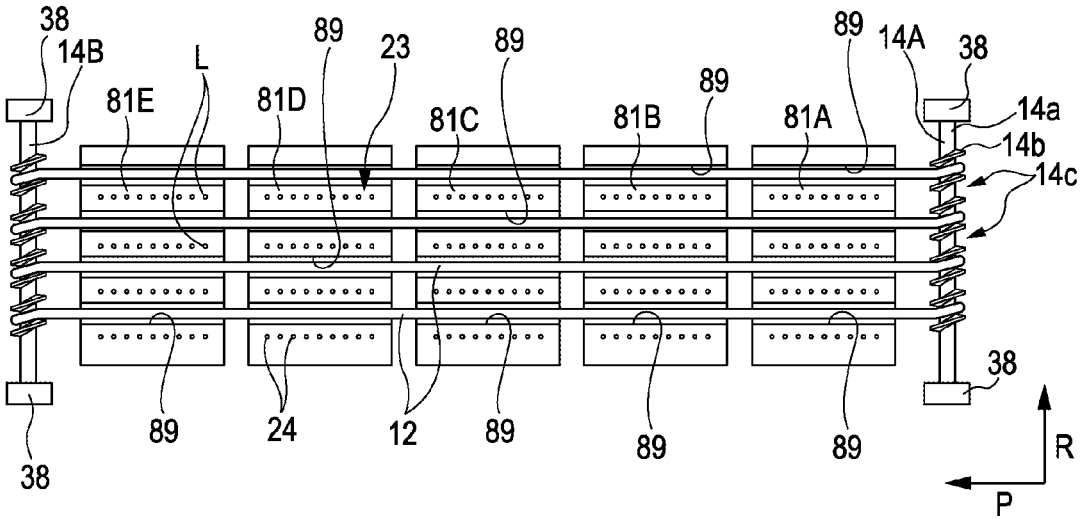
FIG. 14A is a plan view illustrating a retreat position of the absorbing member of the second embodiment.
Figure 14B:
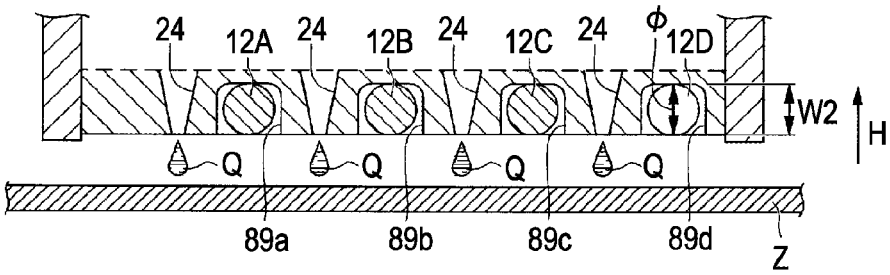
FIG. 14B is a cross-sectional view illustrating the same.

FIG. 12 is a main perspective view illustrating a schematic configuration of the head unit of the printer of the second embodiment. FIG. 13A is a plan view illustrating the flushing unit at the flushing position, and FIG. 13B is a cross-sectional view illustrating the same. FIG. 14A is a plan view illustrating the flushing unit at the retreat position, and FIG. 14B is a cross-sectional view illustrating the same.

In the second embodiment, as shown in FIG. 12, a head unit 72 has a configuration in which printing heads 81A to 81E are disposed inside an opening portion 85 formed in an attachment plate 82. Specifically, the printing heads 81A to 81E are screw-fixed to a rear surface 82*b* of the attachment plate 82 so that the nozzle surface 23 protrudes from a front surface 82*a* of the attachment plate 82 via the opening portion 85. In addition, the head unit 72 is mounted to the printer in such a manner that the attachment plate 82 is fixed to a carriage (not shown).

Each of the printing heads 81A to 81E is provided with accommodating portions 89 for the absorbing member 12, and the number of the accommodating portions 89 is equal to the number of the absorbing members 12 (refer to FIGS. 12, 13A, and 13B). Each of the accommodating portions 89 may be a concave portion (a groove) that extends in the extension direction P of the nozzle row L and is provided on the nozzle surface 23 of the printing head 81. It is desirable that the depth W2 from the nozzle surface 23 of the accommodating portion 89 formed as the concave portion is equal to or larger than the diameter $\phi$ in the cross-section of the absorbing member 12.

By using the operations of both the movement members 14A and 14B and the vertical movement member 38, the absorbing member 12 is movable between two operation positions, that is, the flushing position (refer to FIGS. 13A and 13B) where the absorbing member overlaps with the nozzle row L and away from the nozzle surface 23 by a predetermined distance and the retreat position (refer to FIGS. 14A and 14B) where the absorbing member does not overlap with the nozzle row L and is accommodated inside the accommodating portion (the concave portion) 89.

In the flushing position (refer to FIGS. 13A and 13B), the absorbing members 12 respectively face the plurality of corresponding nozzle rows L (the plurality of nozzles 24 constituting the nozzle rows L) while maintaining a flight distance of a predetermined ink droplet Q, and are capable of absorbing the ink droplets ejected from the nozzle rows L during the flushing process.

On the other hand, in the retreat position (refer to FIGS. 14A and 14B), the absorbing members 12A and 12D are respectively accommodated in the accommodating portions (the concave portions) 89*a* to 89*d* formed in the printing head 81 while not facing the nozzle rows L (the plurality of nozzles 24 constituting the nozzle rows L), and the ink droplet Q ejected from the nozzle 24 can be ejected to the medium (the printing sheet) Z.

In the printer with such a configuration, when the flushing process starts on the basis of a predetermined command, the movement mechanism (the first movement mechanism) 14 is driven so that the plurality of supported absorbing members 12 is moved to the flushing position shown in FIGS. 13A and 13B. Specifically, when the movement members 14A and 14B are moved by the vertical movement member 38 in the direction away from the nozzle surface 23 in the ejection direction H while the movement members 14A and 14B are rotated in the normal direction by a predetermined number of revolutions (in the embodiment, one revolution), the absorbing members 12A to 12D respectively accommodated in the accommodating portions (the concave portions) 89*a* to 89*d* respectively face the nozzle rows L of the printing heads 21A to 21E with a predetermined gap therebetween. With such a configuration, it is possible to respectively dispose four absorbing members 12A to 12D on the ink ejection direction of each of the nozzle rows L.

Next, the control device performs the flushing process on the head unit 72, and ejects the ink droplet Q from the nozzle rows L (the nozzles 24) of the printing heads 81A to 81E toward the absorbing members 12A to 12D facing the nozzle rows L (for example, about 10 droplets). The ink droplet Q ejected from the nozzle row L is absorbed by the absorbing member 12.

The control device moves the absorbing members 12 in the extension direction of the nozzle row indicated by the arrow P in FIGS. 13A, 13B, 14A, and 14B by driving the movement mechanism (the second movement mechanism) 13 so that the portion absorbing the ink in the absorbing member 12 is wound while the flushing process is performed on the head unit 2. Accordingly, since the ink droplet ejected from the nozzle row L is ejected to a new portion not containing the ink of the absorbing member 12 at all times, the ink is reliably and rapidly absorbed to the absorbing member 12.

When the flushing process ends, the control device moves the plurality of absorbing members 12 to the retreat position as shown in FIGS. 14A and 14B by driving the movement mechanism 14. Specifically, the movement members 14A and 14B are rotated in the reverse direction by a predetermined number of revolutions, and the movement members 14A and 14B are moved toward the nozzle surface 23 in the ejection direction H by the vertical movement member 38, so that the absorbing members 12A to 12D are respectively accommodated inside the accommodating portions (the concave portions) 89*a* to 89*d*. Accordingly, the absorbing members 12 are respectively accommodated inside the accommodating portions (the concave portions) 89*a* to 89*d* while the absorbing members 12 do not face the nozzle rows L (the plurality of nozzles 24 constituting the nozzle rows L). In the retreat position, the ink droplet Q ejected from the nozzle 24 can be ejected to the medium (the printing sheet) Z.

Further, in the embodiment, since the size of the cross-section of each of the accommodating portions (the concave portions) 89*a* to 89*d* is set to be slightly larger than that of the absorbing member 12, it is possible to hold a predetermined amount of fluid (ink) inside the accommodating portion (the concave portion) 89 without leaking the fluid by the use of the tension of the fluid even when the absorbing member 12 is not wound by the movement mechanism (the second movement mechanism) 13 during the flushing process. For this reason, the following control is desirable. When the number of the flushing processes is recorded by a counter or the like, and the flushing process is performed by a predetermined number of times, the movement mechanism (the second movement mechanism) 13 is operated while the absorbing member 12 is accommodated at the retreat position, that is, the accommodating portion (the concave portion) 89. Then, the portion absorbing the fluid in the absorbing member 12 is wound, and the fluid (the ink) remaining inside the accommodating portion (the concave portion) 89 can be cleaned.

As described above, in the first embodiment, an example has been described in which the accommodating portion is formed by the projection portion protruding from the nozzle surface. Further, in the second embodiment, an example has been described in which the accommodating portion is formed by the concave portion formed on the nozzle surface. However, it is desirable that the accommodating portion is formed by a combination thereof.

Figure 15:
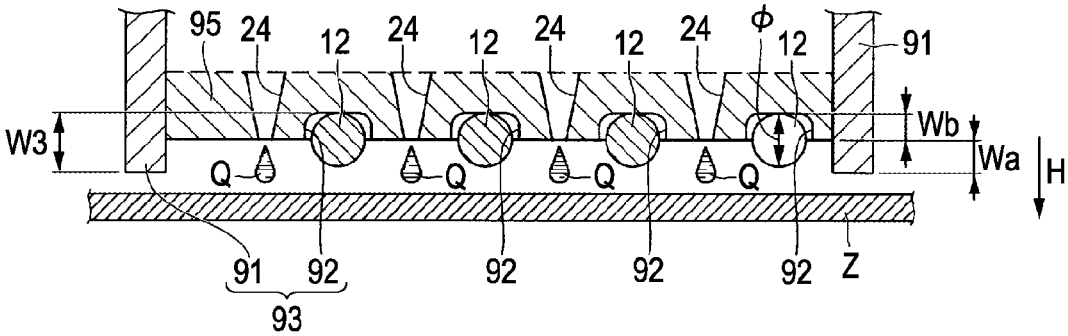
FIG. 15 is a plan view and a cross-sectional view illustrating a retreat position of an absorbing member of another embodiment.

For example, in the embodiment shown in FIG. 15, projection portions (cover heads) 91 protruding from the nozzle surface 23 in the ejection direction H and concave portions 92 formed in the nozzle surface 23 form an accommodating portion 93 for the absorbing member 12 at the retreat position. In this embodiment, the sum W3 of the projection height Wa from the nozzle surface 23 in the ejection direction R of the projection portion 91 and the depth Wb from the nozzle surface 23 of the concave portion 92 is equal to or larger than the diameter $\phi$ in the cross-section of the absorbing member 12.

With such a configuration, the absorbing member 12 accommodated in the concave portion 92 is accommodated in an accommodating portion 93 so as not to protrude from the upper end of the projection portion 91. Then, since it is possible to decrease the depth of the concave portion 92 formed in the nozzle surface 23 by forming the projection portion (the cover head) 91, the concave portion 92, and the accommodating portion 93, it is possible to decrease the thickness of the nozzle plate 95.

While the preferred embodiments of the invention are described as above with reference to the accompanying drawings, it is needless to say that the invention is not limited to the preferred embodiments, and the preferred embodiments may be combined with each other. It is apparent that various modifications and corrections can be made by the person skilled in the art within the scope of the technical spirit according to the claims, and it should be, of course, understood that the modifications and corrections are included in the technical scope of the invention.

For example, a cleaning mechanism may be provided in the printer 1 of the first embodiment. In this case, when the cleaning mechanism is disposed on the downstream side in the movement direction of the absorbing member 12 (the downstream side of the movement member 14B), it is possible to perform a cleaning process or the like of cleaning the absorbing member 12 having the ink absorbed thereto. The absorbing member 12 that can be recycled after the cleaning process is wound on the rotation portion 16, and when the rotation portions 15 and 16 are rotated in the reverse direction, the flushing process can be performed again.

Further, the number of the absorbing members may be appropriately set in accordance with the nozzle rows L of the printing head 21. In the above-described embodiments, one absorbing member is provided for each of the nozzles rows L, but one absorbing member may be provided for plural nozzle rows L. In this case, a configuration is adopted in which the width of the absorbing member is set to match with the corresponding plural nozzle rows L.

Furthermore, in the first embodiment, the plural absorbing members 12 are adapted to be simultaneously wound, but may be adapted to be separately wound.

In the above-described embodiments, the configuration is described in which the absorbing members 12 extend in parallel to the extension direction of the nozzle rows. However, the invention is not limited thereto, and the extension direction of the absorbing members 12 may not be perfectly parallel to the extension direction of the nozzle rows. That is, in the invention, the meaning that the absorbing members extend along the extension direction of the nozzle rows includes the case where the extension line extending in the extension direction of the nozzle rows intersects the extension line extending in the extension direction of the absorbing members in the front region as well as the case where the extension direction of the absorbing members is perfectly parallel to the extension direction of the nozzle rows.

In the above-described embodiments, a configuration is described in which the invention is applied to the line head type printer. However, the invention is not limited thereto, but may be applied to a serial type printer.

In the above-described embodiments, the ink jet printer is adopted, but a fluid ejecting apparatus for ejecting a fluid other than ink or a fluid container for storing the fluid may be adopted. Various fluid ejecting apparatuses including a fluid ejecting head for ejecting a minute amount of liquid droplet may be adopted. In addition, the liquid droplet indicates the fluid ejected from the fluid ejecting apparatus, and includes a liquid having a particle shape, a tear shape, or a linear shape. Further, here, the fluid may be a material which can be ejected from the liquid ejecting apparatus.

For example, a liquid-state material may be used, and includes a liquid-state material such as sol or gel water having a high or low viscosity, a fluid-state material such as an inorganic solvent, an organic solvent, a liquid, a liquid-state resin, or liquid-state metal (metallic melt), and a material in which a functional material having a solid material such as pigment or metal particle is dissolved, dispersed, or mixed with a solvent in addition to a fluid. In addition, ink or liquid crystal described in the embodiments may be exemplified as a typical example of the fluid. Here, the ink indicates general water-based ink, oil-based ink, gel ink, or hot-melt ink which contains various fluid compositions.

As a detailed example of the fluid ejecting apparatus, for example, a liquid crystal display, an EL (electro-luminance) display, a plane-emission display, a fluid ejecting apparatus for ejecting a fluid containing dispersed or melted materials such as an electrode material or a color material used to manufacture a color filter, a fluid ejecting apparatus for ejecting a biological organic material used to manufacture a biochip, a fluid ejecting apparatus for ejecting a fluid as a sample used as a precise pipette, a silkscreen printing apparatus, or a micro dispenser may be used.

In addition, a fluid ejecting apparatus for ejecting lubricant from a pinpoint to a precise machine such as a watch or a camera, a fluid ejecting apparatus for ejecting a transparent resin liquid such as a UV-curing resin onto a substrate in order to form a minute hemispherical lens (optical lens) used for an optical transmission element or the like, or a fluid ejecting apparatus for ejecting an etching liquid such as an acid liquid or an alkali liquid in order to perform etching on a substrate or the like may be adopted. Further, the invention may be applied to any one of the fluid ejecting apparatuses and a fluid container thereof.

What is claimed is:

1. A fluid ejecting apparatus comprising:

a fluid ejecting head which has nozzle rows formed by a plurality of nozzles and ejects a fluid to a medium;

an absorbing member absorbs the fluid that is ejected from the nozzles during a flushing process, and is a linear member which extends along a nozzle row;

a first movement mechanism which relatively moves the absorbing member in a direction intersecting the extension direction of the nozzle rows between a retreat position where the absorbing member retreats from an ejection path of the nozzles and a flushing position where the absorbing member overlaps with the ejection direction; and an accommodating portion which is formed on the fluid ejecting head and accommodates the absorbing member at the retreat position, wherein the accommodating portion is a concave portion which extends in the extension direction of the nozzle row and is formed on the nozzle surface of the fluid ejecting head, and wherein the depth of the concave portion from the nozzle surface is equal to or larger than the diameter of the absorbing member in the cross-section.

2. The fluid ejecting apparatus according to claim 1, wherein the first movement mechanism changes a relative position between the absorbing member and the fluid ejecting head in the ejection direction.

3. The fluid ejecting apparatus according to claim 2, wherein the accommodating portion is an area defined by a projection portion protruding from the nozzle surface of the fluid ejecting head in the ejection direction and extending in the extension direction of the nozzle row.

4. The fluid ejecting apparatus according to claim 3, wherein the projection height of the projection portion from the nozzle surface is equal to or larger than the diameter of the cross-section of the absorbing member.

5. The fluid ejecting apparatus according to claim 4, further comprising:

a second movement mechanism that moves the absorbing member in the extension direction by rotationally driving a rotation body.

6. The fluid ejecting apparatus according to claim 1, further comprising:

a second movement mechanism which moves the absorbing member in the extension direction by rotationally driving a rotation body.

* * * * *